US007585234B2

(12) United States Patent
Reeb

(10) Patent No.: US 7,585,234 B2
(45) Date of Patent: Sep. 8, 2009

(54) LACROSSE HEAD HAVING A TRANSVERSE RAIL

(75) Inventor: David Reeb, Columbia, MD (US)

(73) Assignee: WM. T. Burnett IP, LLC, Baltimore, MD (US)

( * ) Notice: Subject to any disclaimer, the term of this patent is extended or adjusted under 35 U.S.C. 154(b) by 377 days.

(21) Appl. No.: 11/493,007

(22) Filed: Jul. 26, 2006

(65) Prior Publication Data

US 2007/0072708 A1 Mar. 29, 2007

Related U.S. Application Data

(60) Provisional application No. 60/702,684, filed on Jul. 27, 2005.

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 505; D21/724
See application file for complete search history.

(56) References Cited

U.S. PATENT DOCUMENTS

D286,666 S 11/1986 Brine, Jr.
D286,803 S 11/1986 Brine, Jr.
4,657,260 A * 4/1987 Brine, Jr. ..... 473/513
D297,963 S * 10/1988 Tucker et al. ..... D21/724
5,035,434 A 7/1991 Taylor et al.
5,494,297 A 2/1996 MacNeil
5,566,947 A 10/1996 Tucker et al.
5,674,140 A 10/1997 Tucker et al.
6,921,347 B1 * 7/2005 Morrow et al. ..... 473/513
7,104,904 B1 * 9/2006 Gait ..... 473/513

OTHER PUBLICATIONS deBeer Webpage, 2003,www.debeerlacrosse.com,2 pages.*
STX Lacrosse 2003 Equipment Apparel, Grab Hold; http://www.STXLACROSSE.com.

* cited by examiner

*Primary Examiner*—Gene Kim
*Assistant Examiner*—M Chambers
(74) *Attorney, Agent, or Firm*—Paul, Hastings, Janofsky & Walker LLP

(57) ABSTRACT

A lacrosse head is provided that includes a base and two sidewalls connected to the base. Each of the sidewalls includes an upper rail, a lower rail, and a transverse rail. The transverse rail is connected to the upper rail and the lower rail and disposed outwardly of the upper rail and the lower rail. A scoop is connected to the two sidewalls opposite to the base. Various configurations and geometries are disclosed, which comprise the several embodiments of the present invention.

24 Claims, 3 Drawing Sheets

LACROSSE HEAD HAVING A TRANSVERSE RAIL

This application claims the benefit of U.S. Provisional Application No. 60/702,684, filed Jul. 27, 2005, which is incorporated herein by reference in its entirety.

BACKGROUND

1. Field of the Invention

The present invention relates generally to lacrosse heads. More particularly, the present invention relates to lacrosse heads having a transverse rail disposed outwardly from an upper rail and a lower rail providing, for example, a truss-like construction.

2. Background of the Invention

Since the advent of double-wall synthetic lacrosse heads, lacrosse head designers have continually pursued lighter lacrosse heads that still provide the structural rigidity and durability required for the rigors of the game. Early versions of conventional double-wall synthetic lacrosse heads featured solid wall construction, in which the sidewalls and scoop were solid except for perhaps stringing holes. Although this solid construction met structural requirements, these types of heads tended to be quite heavy and difficult to maneuver.

As molding techniques and materials improved, lacrosse head designs moved away from completely solid constructions in favor of open sidewall constructions. By positioning openings through the sidewalls, designers were able to reduce the overall weight of the head and improve the feel and maneuverability of the head. However, in striving to reduce weight as much as possible, some open sidewall designs suffer from unwanted flexibility and susceptibility to deformation and breaking. The unwanted flexibility hinders a player's ability to control a ball in the head and execute accurate passing and shooting. Thus, there remains a need for the lightest possible lacrosse head that still meets the structural requirements for durability and rigidity required for competitive play.

SUMMARY OF THE INVENTION

The present invention is directed toward a significantly lighter, more aerodynamic lacrosse head. An embodiment of the present invention provides a lacrosse head comprising a base, two sidewalls connected to the base, and a scoop connected to the two sidewalls opposite to the base, where each sidewall comprises an upper rail, a lower rail, and a transverse rail. The transverse rail is connected to and disposed outwardly from the upper rail and lower rail.

DETAILED DESCRIPTION OF THE INVENTION

Figure 1:
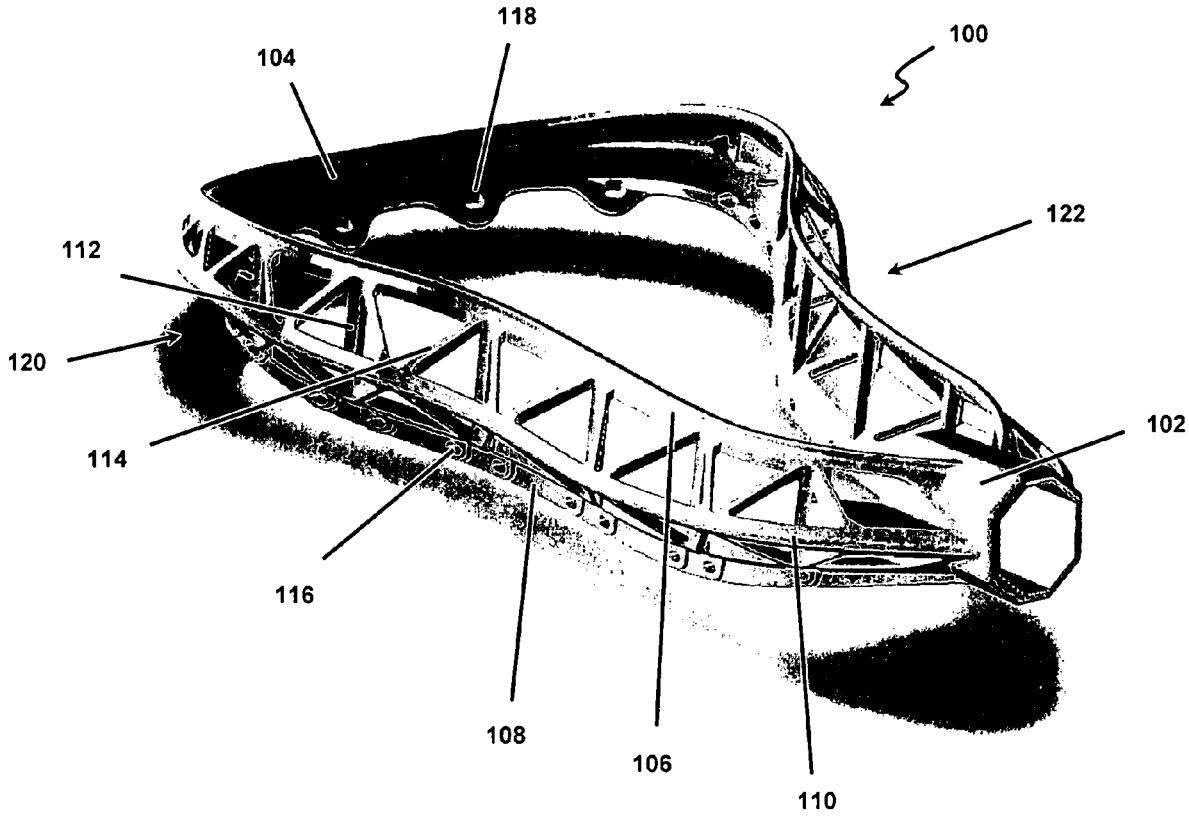
FIG. 1 is a schematic diagram showing an exemplary lacrosse head in accordance with a first embodiment of the present invention.
Figure 2:
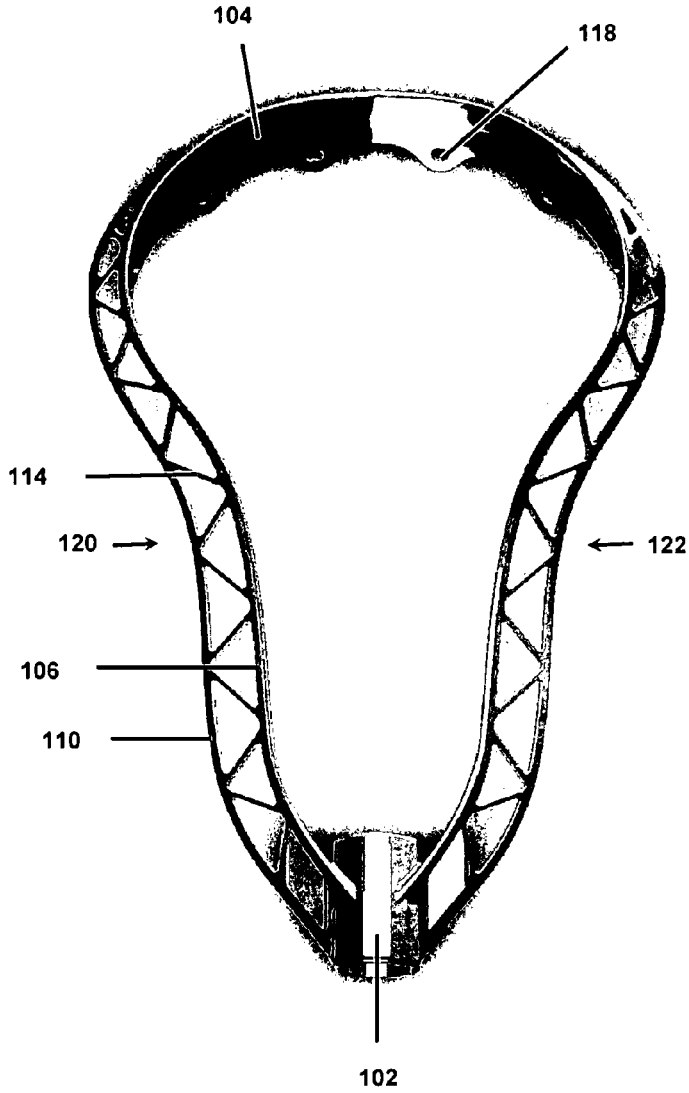
FIG. 2 is a schematic diagram showing a plan view of the lacrosse head shown in FIG. 1.
Figure 3:
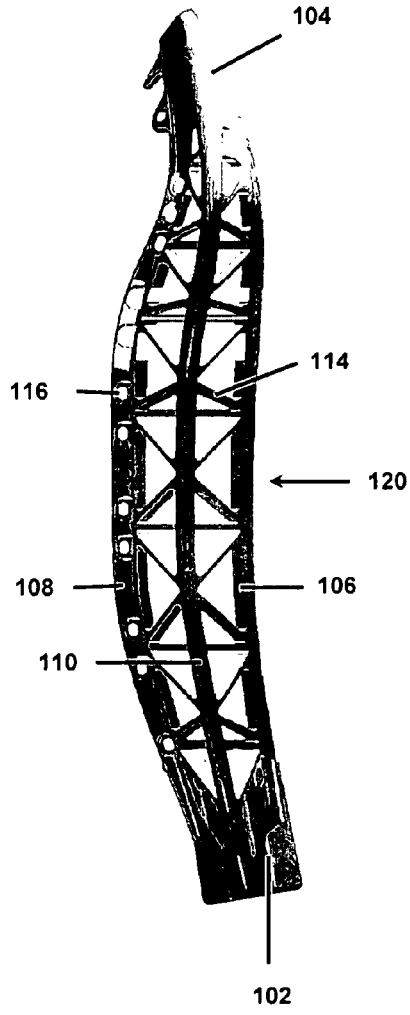
FIG. 3 is a schematic diagram showing a side view of the lacrosse head shown in FIG. 1.

FIG. 1 is a schematic diagram showing an exemplary lacrosse head 100 in accordance with a first embodiment of the present invention. FIGS. 2 and 3 are schematic diagrams showing a plan view and a side elevation view, respectively, of the lacrosse head 100 shown in FIG. 1. As shown in this embodiment, lacrosse head 100 comprises a frame having a base 102, two sidewalls 120 and 122 connected to base 102, and a scoop 104 connected to sidewalls 120 and 122 opposite to base 102. Base 102 is adapted to receive a shaft (not shown). A web or pocket (not shown) can be attached to string holes 118 located in the scoop 104 and string holes 116 located in the lower rails 108 of sidewalls 120 and 122. Together, base 102, sidewalls 120 and 122, and scoop 104 define the interior of lacrosse head 100.

Each sidewall of sidewalls 120 and 122 comprises an upper rail 106, a lower rail 108, and a transverse rail 110. Upper rail 106 and lower rail 108 are connected by one or more vertical members 112. In the exemplary head 100 of FIGS. 1-3, members 112 are arranged in a generally vertical direction in between upper rail 106 and lower rail 108 with respect to the horizontal axis according to which base 102 receives a shaft. In this embodiment, members 112 form a series of rectangular openings between upper rail 106 and lower rail 108. Alternatively, the members 112 connecting upper rail 106 and lower rail 108 can be arranged in directions other than a vertical direction to form geometric openings other than rectangular openings, such as triangular openings.

As shown best in FIG. 2, transverse rail 110 is disposed outwardly of rails 106 and 108 with respect to the interior of head 104. Transverse rail 110 can be connected to upper rail 106 and lower rail 108 by one or more transverse truss members 114. In the embodiment of FIGS. 1-3, upper rail 106, lower rail 108, and transverse rail 110 are positioned in a triangular orientation to provide a truss-like formation. In other words, a cross section of sidewall 120 or 122 taken perpendicular to the longitudinal axis of the sidewall would be roughly triangular.

As shown in FIGS. 1-3, pairs of transverse truss members 114 connected along upper rail 106 converge at transverse rail 110 to form triangular openings between the transverse truss members 114. Similarly, pairs of transverse truss members 114 connected along lower rail 108 converge at transverse rail 110 to form triangular openings. When viewed from above, as shown in FIG. 2, transverse truss members 114 create a series of triangular openings in sidewalls 120 and 122. Alternatively, instead of triangular openings, transverse truss members 114 could extend from rails 106 and 108 to transverse rail 110 in other configurations, for example, creating trapezoidal, rectangular, or square openings between transverse rail 110 and rails 106 and 108.

An aspect of the present invention relates to the relative positioning of rails 106, 108, and 110 with respect to their location around head 100. For example, as shown in the embodiment of FIGS. 1-3, transverse rail 110 is positioned more outwardly of rails 106 and 108 in areas of the sidewalls 120 and 122 proximate to the base 102 than in areas more toward the scoop 104. Indeed, toward the scoop 104 of head 100, rails 106, 108, and 110 converge and transition into the solid scoop 104. In contrast, toward the base 102 of head 100, rails 106, 108, and 110 do not converge and instead independently connect to the base 102. Of course, as one of ordinary skill in the art would appreciate, configurations other than the particular embodiment shown in FIGS. 1-3 are possible, such as converging rails 106, 108, and 110 at base 102 or keeping transverse rail 110 disposed outwardly of rails 106 and 108 throughout the sidewalls and the scoop.

Instead of the transverse rail comprising one rail member as shown in FIGS. 1-3, an alternative embodiment of the present invention provides a transverse rail that includes two or more transverse rail members. For example, two transverse rail members could be provided to create a square, rectangular, or trapezoidal beam construction, as viewed in a cross section taken perpendicular to the longitudinal axis of the sidewall. In this case, transverse truss members could connect the upper rail to the upper transverse rail member and the lower rail to the lower transverse rail member, and additional vertical members could connect the upper transverse rail member to the lower transverse rail member.

As another example, the transverse rail could include three transverse rail members to create a pentagonal beam construction, as viewed in a cross section taken perpendicular to the longitudinal axis of the sidewall. In this case, transverse truss members could connect the upper rail to the uppermost transverse rail member and the lower rail to the lowermost transverse rail member, and additional members could connect the uppermost transverse rail member to the outermost transverse rail member, and the outermost transverse rail member to the lowermost transverse rail member.

Figure 4:
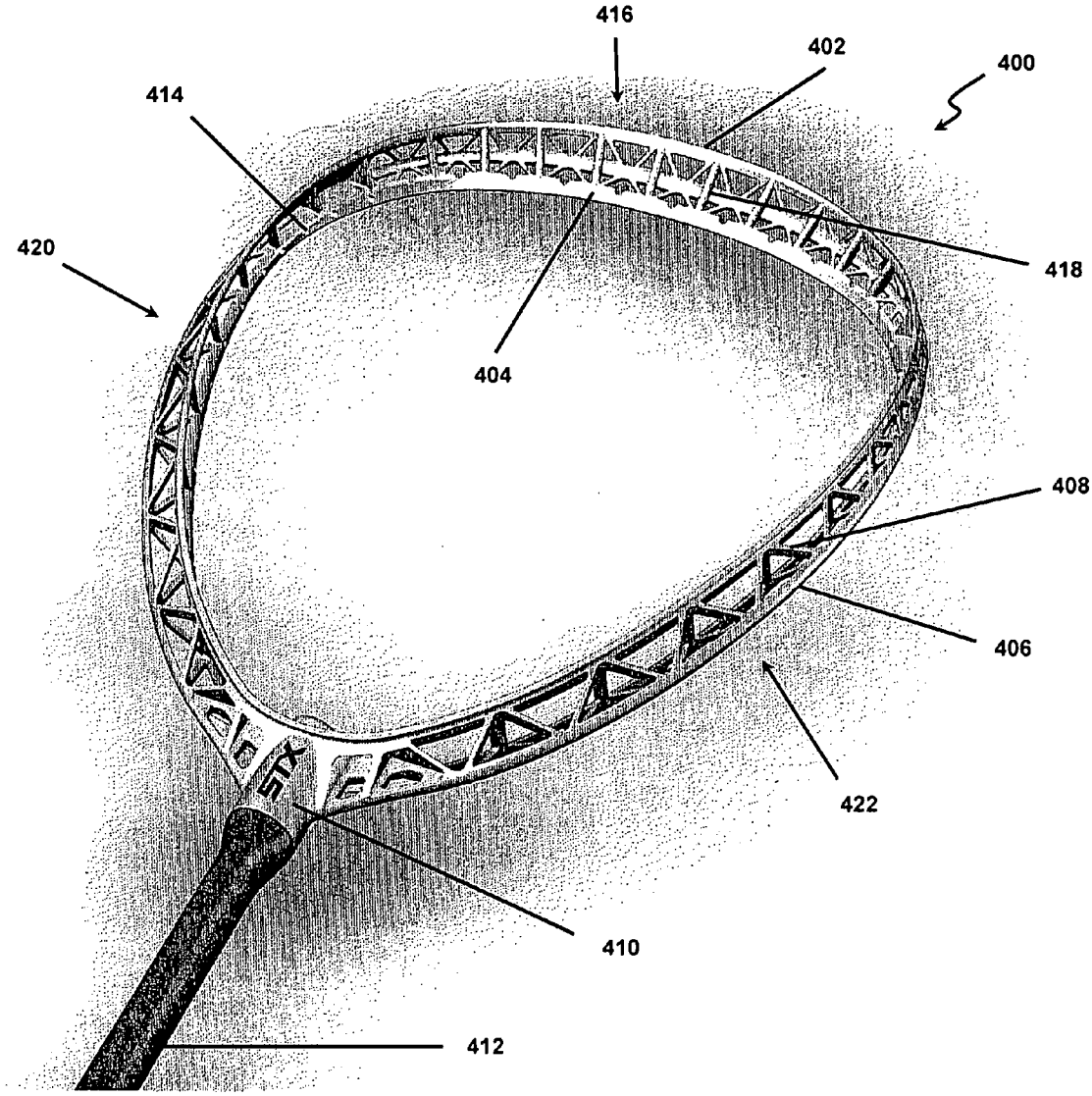
FIG. 4 is a schematic diagram showing an exemplary goalie lacrosse head in accordance with a second embodiment of the present invention.

FIG. 4 is a schematic diagram showing an exemplary goalie lacrosse head 400 in accordance with a second embodiment of the present invention. As shown, head 400 comprises a frame having a base 410, two sidewalls 420 and 422 connected to base 410, and a scoop 416 joining the sidewalls 420 and 422 opposite base 410. Base 410 is adapted to receive a lacrosse shaft 412. A web or pocket (not shown) can be attached to string holes 414 defined in head 400. Together, base 410, sidewalls 420 and 422, and scoop 416 define the interior of lacrosse head 400.

Sidewalls 420 and 422 and scoop 416 comprise an upper rail 402, a lower rail 404, and a transverse rail 406. Transverse rail 406 is disposed outwardly of upper rail 402 and lower rail 404, with respect to a plane defined between upper rail 402 and lower rail 404. Such a plane would correspond to the surface of sidewalls 420 or 422 or scoop 416 that generally faces the interior of head 400. As shown in FIG. 4, transverse rail 406 is disposed more outwardly with respect to the plane along the sidewalls than the transverse rail 406 is with respect to the plane along the scoop.

Upper rail 402 and lower rail 404 can be connected by one or more members 418.

In the embodiment of FIG. 4, along a substantial portion of sidewalls 420 and 422, members 418 are arranged in generally a vertical direction in between upper rail 402 and lower rail 404 with respect to the horizontal axis according to which base 410 receives shaft 412. Along scoop 416, members 418 are arranged so that they incline outward from the interior of head 400. In this embodiment, members 418 form rectangular openings along sidewalls 420 and 422 and scoop 416. Alternatively, members 418 can be arranged to form geometric openings other than rectangular openings, such as triangular openings.

As shown in FIG. 4, transverse rail 406 is disposed outwardly of rails 402 and 404 with respect to the plane defined between rails 402 and 404. Transverse rail 406 can be connected to upper rail 402 and lower rail 404 by one or more transverse members 408. In the embodiment of FIG. 4, upper rail 402, lower rail 404, and transverse rail 406 are positioned in a triangular orientation to provide a truss-like formation. In other words, a cross section of sidewalls 420 or 422 or scoop 416 taken perpendicular to its longitudinal axis would be roughly triangular.

As shown in FIG. 4, pairs of transverse members 408 connected along the upper rail 402 converge at transverse rail 406 to form triangular openings between the transverse members 408. Similarly, pairs of transverse members 408 connected along lower rail 404 converge at transverse rail 406 to form triangular openings. When viewed from above, the plurality of transverse members 408 creates a series of triangular openings in the sidewalls 420 and 422 and scoop 416. Alternatively, instead of triangular openings, transverse members 408 could extend from rails 402 and 404 to transverse rail 406 in other configurations, for example, creating trapezoidal, rectangular, or square openings between transverse rail 406 and rails 402 and 404.

An aspect of the present invention relates to the relative positioning of rails 402, 404, and 406 with respect to their location around head 400. For example, as shown in the embodiment of FIG. 4, transverse rail 406 is positioned more outwardly of the plane defined between rails 402 and 404 in areas of the sidewalls 420 and 422 than in areas of the scoop 416. Of course, as one of ordinary skill in the art would appreciate, configurations other than the particular embodiment shown in FIGS. 4 are possible.

In addition, as with the embodiment of FIGS. 1-3, instead of the single transverse rail 406 shown in FIG. 4, an alternative embodiment of the present invention provides two or more transverse rails.

According to another embodiment of the present invention, a lacrosse head frame has a base, a scoop, and sidewalls that extend from the base to the scoop, the sidewalls having an upper rail, a lower rail (perhaps, with string holes), and a transverse rail between the upper and lower rails and disposed outwardly from the upper and lower rails substantially along the length of the frame to form a hollow space within the sidewalls. The transverse rail and the upper and lower rails are connected by a plurality of transverse members.

According to another embodiment of the present invention, a lacrosse head frame has a base, a scoop, and sidewalls that extend from the base to the scoop, the sidewalls having a multi-sided skeletal construction, one or more sections of the inner side of a multi-sided sidewall having an area approximately equal to the sum of the areas of the corresponding portion of each of the remaining outer sides of the multi-sided sidewall.

According to another embodiment of the present invention, a lacrosse head frame has a base, a scoop, and sidewalls that extend from the base to the scoop, the sidewalls having an upper rail and a lower rail, each no greater than ⅜" in height, and a transverse rail between the upper and lower rails and disposed outwardly from the upper and lower rails substantially along the length of the frame to form a hollow space within the sidewalls. The transverse rail and the upper and lower rails are connected by a plurality of transverse members.

According to an embodiment of the present invention, string holes are formed in one or more of the upper rail, lower rail, and transverse rail, which can provide options for stringing a pocket to the head. As another embodiment, instead of or in addition to string holes formed in the head, a lacing string is laced through the rails and transverse truss members and a pocket is attached to the lacing string.

Examples of suitable materials for a lacrosse head according to the present invention include nylon, composite materials, elastomers, metal, urethane, polycarbonate, polyethylene, polypropylene, polyketone, polybutylene terephalate, acetals (e.g., Delrin™ by DuPont), acrylonitrile-butadiene-styrene (ABS), acrylic, acrylic-styrene-acrylonitrile (ASA), alcryn (partially crosslinked halogenated polyolefin alloy), styrene-butadiene-styrene, styrene-ethylene-butylene styrene, thermoplastic olefinic (TPO), thermoplastic vulcanizate (TPV), ethylene-propylene rubber (EPDM), and polyvinyl chloride (PVC).

The truss-like construction of a lacrosse head according to an embodiment of the present invention operates in a manner similar to bridges having truss formations. Alone, the upper rails and lower rails would be subject to tension, shear, and bending forces during play, making them susceptible to bending. However, adding the transverse rail and connecting transverse members of the present invention provides additional strength and allows the upper and lower rails and their interconnecting members to be thinner and therefore lighter. With the plurality of transverse members in compression and the beams in tension, the truss-like formation provides stiffness both in frontward-to-backward directions and side-to-side directions, thereby preventing bending during play. In addition, unlike conventional heads, the present invention provides similar load bearing strength performance in these two directions. The thinner members and larger openings also improve the aerodynamics of the head.

Overall, the present invention provides a significantly lighter, more aerodynamic lacrosse head that, due to the transverse rail and truss-like construction, retains the requisite strength of a conventional head in the vertical direction (and therefore does not flex too much so as to make a pass or shot difficult to control), and is even stronger than conventional heads in the horizontal direction, i.e., side-to-side (due principally to the transverse rail). The lightness and aerodynamics makes for a more maneuverable head that can be whipped at higher speed, thereby increasing shooting and passing speed. In meeting the need for a lighter lacrosse head that also can withstand the rigors of the game (such as checking, scooping, poke checking, and accurate shooting), the lacrosse head construction of the present invention provides significant benefits in weight reduction and strength retention.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims, and by their equivalents.

What is claimed is:

1. A lacrosse head, comprising:

a base;

two sidewalls connected to the base, each sidewall comprising:

an upper rail;

a lower rail; and a transverse rail connected to the upper rail and the lower rail by truss members; and a scoop connected to the two sidewalls opposite to the base, wherein the base, the two sidewalls, and the scoop define an interior of the lacrosse head, and wherein for substantially the entire length of the each sidewall:

the upper rail is spaced apart from the lower rail to define an opening, the transverse rail is spaced apart from and disposed outwardly of the upper rail and the lower rail with respect to the interior of the lacrosse head, such that in a cross section of the each sidewall, the upper rail, the lower rail, and the transverse rail define vertices of a polygon, a plurality of upper truss members connect the upper rail to the transverse rail, wherein each upper truss member extends from the upper rail in a direction away from the interior of the lacrosse head and along a first side of the polygon, and a plurality of lower truss members connect the lower rail to the transverse rail, wherein each lower truss member extends from the lower rail in a direction away from the interior of the lacrosse head and along a second side of the polygon.

2. The lacrosse head of claim 1, wherein the transverse rail comprises two or more transverse rail members, the two or more transverse rail members being connected to the upper rail, the lower rail, or another of the transverse rail members and disposed outwardly of the upper rail and the lower rail.

3. The lacrosse head of claim 2, wherein each sidewall has two transverse rail members and has a cross section that is one of generally rectangular and generally square.

4. The lacrosse head of claim 2, wherein each sidewall has two transverse rail members and has a cross section that is generally trapezoidal.

5. The lacrosse head of claim 2, wherein each sidewall has three transverse rail members and has a cross section that is generally pentagonal.

6. The lacrosse head of claim 1, wherein adjacent truss members along each of the upper rail and the lower rail converge at the transverse rail to form triangular openings.

7. The lacrosse head of claim 1, wherein adjacent truss members along each of the upper rail and the lower rail extend to the transverse rail to form at least one of square and rectangular openings.

8. The lacrosse head of claim 1, wherein adjacent truss members along each of the upper rail and the lower rail extend to the transverse rail to form trapezoidal openings.

9. The lacrosse head of claim 1, wherein the transverse rail, upper rail, and lower rail converge at the scoop to form a solid scoop member,

10. The lacrosse head of claim 1, wherein each of the upper rail, lower rail, and transverse rail is connected to the base at different locations.

11. The lacrosse head of claim 1, wherein the scoop comprises the upper rail, the lower rail, and the transverse rail, the transverse rail disposed outwardly of the upper rail and the lower rail.

12. The lacrosse head of claim 1, wherein the transverse rail, upper rail, and lower rail converge at the base.

13. A method of forming the lacrosse head of claim 1, comprising:

providing a base;

extending two sidewalls from the base, each of the sidewalls comprising:

an upper rail;

a lower rail;

a transverse rail connected to the upper rail and the lower rail by truss members; and connecting the sidewalls with a scoop, wherein the base, the two sidewalls, and the scoop define an interior of the lacrosse head, and wherein for substantially the entire length of the each sidewall, the method further comprises:

spacing the upper rail apart from the lower rail to define an opening, disposing the transverse rail spaced apart from and outwardly of the upper rail and the lower rail with respect to the interior of the lacrosse head, such that in a cross section of the each sidewall, the upper rail, the lower rail, and the transverse rail define vertices of a polygon, connecting the upper rail to the transverse rail with a plurality of upper truss members, wherein each upper truss member extends from the upper rail in a direction away from the interior of the lacrosse head and along a first side of polygon, and connecting the lower rail to the transverse rail with a plurality of lower truss members, wherein each lower truss member extends from the lower rail in a direction away from the interior of the lacrosse head and along a second side of the polygon.

14. The method of claim 13, wherein the transverse rail comprises two or more transverse rail members, the two or more transverse rail members being connected to the upper rail, the lower rail, or another of the transverse rail members and disposed outwardly of the upper rail and the lower rail.

15. The method of claim 14, wherein each sidewall has two transverse rail members and has a cross section that is one of generally rectangular and generally square.

16. The method of claim 14, wherein each sidewall has two transverse rail members and has a cross section that is generally trapezoidal.

17. The method of claim 14, wherein each sidewall has three transverse rail members and has a cross section that is generally pentagonal.

18. The method of claim 13, wherein adjacent truss members along each of the upper rail and the lower rail converge at the transverse rail to form triangular openings.

19. The method of claim 13, wherein adjacent truss members along each of the upper rail and the lower rail extend to the transverse rail to form at least one of square and rectangular openings.

20. The method of claim 13, wherein adjacent truss members along each of the upper rail and the lower rail extend to the transverse rail to form trapezoidal openings.

21. The method of claim 13, wherein the transverse rail, the upper rail, and the lower rail converge at the scoop to form a solid scoop member.

22. The method of claim 13, wherein each of the upper rail, lower rail, and transverse rail is connected to the base at different locations.

23. The method of claim 13, wherein the scoop comprises the upper rail, the lower rail, and the transverse rail, the transverse rail disposed outwardly of the upper rail and the lower rail.

24. The method of claim 13, wherein the transverse rail, upper rail, and lower rail converge at the base.

* * * * *